US009376847B2

(12) United States Patent
Salice

(10) Patent No.: US 9,376,847 B2
(45) Date of Patent: Jun. 28, 2016

(54) HINGE FOR PIECES OF FURNITURE WITH A FRAME

(71) Applicant: Luciano Salice, Carimate (IT)

(72) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

(21) Appl. No.: 14/366,296

(22) PCT Filed: May 22, 2013

(86) PCT No.: PCT/EP2013/060453
§ 371 (c)(1),
(2) Date: Jun. 18, 2014

(87) PCT Pub. No.: WO2014/000980
PCT Pub. Date: Jan. 3, 2014

(65) Prior Publication Data

US 2015/0135479 A1 May 21, 2015

(30) Foreign Application Priority Data

Jun. 26, 2012 (IT) ..... MI2012A1121

(51) Int. Cl.
*E05D 7/04* (2006.01)
*E05D 5/02* (2006.01)

(52) U.S. Cl.
CPC ..... *E05D 7/0423* (2013.01); *E05D 5/0276* (2013.01); *E05D 7/0407* (2013.01); *E05D 2007/0461* (2013.01);
(Continued)

(58) Field of Classification Search
CPC ... E05D 7/0407; E05D 7/0415; E05D 7/0423; E05D 2007/0461; E05D 2007/0476; E05D 5/065; E05D 5/0276; E05Y 2900/20; Y10T 16/532; Y10T 16/5321; Y10T 16/5322; Y10T 16/53225; Y10T 16/5324; Y10T 16/53253; Y10T 16/5383
USPC ..... 16/235–238, 242, 245, 286; 312/326
See application file for complete search history.

(56) References Cited

U.S. PATENT DOCUMENTS 6,643,895 B1 * 11/2003 Domenig et al. ..... 16/238
6,647,591 B1 11/2003 Domenig et al.
6,880,205 B2 * 4/2005 Rupprechter ..... 16/235
(Continued)

OTHER PUBLICATIONS

International Search Report; dated Jun. 24, 2013; International Application No. PCT/EP2013/060453; International Filing Date: May 22, 2013; 5 pages.
(Continued)

*Primary Examiner* — William Miller
(74) *Attorney, Agent, or Firm* — Blank Rome LLP

(57) ABSTRACT

The hinge for mounting a door on a piece of furniture provided with a front frame comprises a base plate fixable to the front frame of the piece of furniture, an intermediate plate slidably connected to the base plate and movable by an adjusting cam, a hinge arm connected to the intermediate plate swingably according to a transversal axis and mobile by means of an adjusting screw; the intermediate plate, at a rear end thereof, exhibits side wings having hinging projections which project on opposite sides according to the transversal axis so as to engage rotatably in rear side holes of the hinge arm. The base plate exhibits retaining side parts for the intermediate plate, conformed and arranged such as to retain the side edges of the intermediate plate in a perpendicular direction to the longitudinal extension plane of the base plate.

14 Claims, 3 Drawing Sheets

(52) U.S. Cl.
CPC .... *E05D 2007/0476* (2013.01); *E05Y 2900/20* (2013.01); *Y10T 16/5321* (2015.01); *Y10T 16/53225* (2015.01)

(56) References Cited

U.S. PATENT DOCUMENTS

| | | | | |
|---|---|---|---|---|
| 7,117,561 | B1 | 10/2006 | Domenig et al. | |
| 7,509,708 | B1 * | 3/2009 | Radke et al. | 16/258 |
| 7,516,516 | B2 * | 4/2009 | Wu | 16/242 |
| 7,591,044 | B2 * | 9/2009 | Migli | 16/235 |
| 8,276,241 | B2 * | 10/2012 | Wu et al. | 16/238 |
| 8,683,652 | B2 * | 4/2014 | Hagspiel | 16/238 |
| 2003/0093877 | A1 | 5/2003 | Hofer | |
| 2006/0137139 | A1 | 6/2006 | Wu | |
| 2008/0271291 | A1 * | 11/2008 | Chen et al. | 16/238 |

OTHER PUBLICATIONS

Written Opinion dated Jun. 24, 2013; International Application No. PCT/EP2013/060453; International Filing Date: May 22, 2013; 4 pages.

* cited by examiner

HINGE FOR PIECES OF FURNITURE WITH A FRAME

RELATED APPLICATIONS

This application is a U.S. national phase application of International Application No. PCT/EP2013/060453, filed May 22, 2013; which application claims priority to Italy Application No. MI2012 A001121, filed Jun. 26, 2012.

FIELD OF USE

The invention concerns a hinge for doors of pieces of furniture provided with a front frame, on which the hinges are fixed.

BACKGROUND OF THE INVENTION

In the furnishing sector, with the aim of swingably supporting furniture doors, use is made of hinges comprising a fixed part connectable to the body of the piece of furniture and a mobile part, constituted by a box, connectable to the door.

In the case of pieces of furniture with a front frame for fixing the hinges, typically used for the United States market, the hinges have to have particularly compact shapes and preferably include the box being connected to the fixed part by means of a single articulation pin.

In known constructional embodiments, the fixed part comprises a base plate fixable to the front frame of the piece of furniture, an intermediate plate and a hinge arm connected to one another slidably and/or swingably via a cam and/or an adjusting screw such as to enable adjusting the door with respect to the piece of furniture. In known hinges, for example U.S. Pat. No. 6,647,591 and U.S. Pat. No. 6,845,544, the base and intermediate plates and the hinge arm are also connected to one another by means of a transversal pin, so that the arrangement of the various connecting and adjusting means between the parts prevents the hinge from being more compact and also lends a certain degree of complexity to the assembly operations of the various parts.

Further, in these known constructional embodiments, the adjusting screw engages with its thread on the edges or profiled wings at an opening of the hinge arm; this is a solution that can lead to imprecision in adjustment and problems of resistance in the coupling between the parts.

SUMMARY OF THE INVENTION

The main aim of the present invention is therefore to provide a hinge for doors of pieces of furniture provided with a front fixing frame, which is constructionally simple and easily assemblable, enabling in this way a reduction of overall costs.

A further aim of the present invention is to provide a hinge of the type under consideration which exhibits a high degree of structural resistance and which enables a considerable degree of precision in adjustment between the parts that it is composed of. A further aim of the invention is to provide a hinge which has the characteristics mentioned above, and exhibits very compact dimensions and shape.

The above can be achieved with a hinge for mounting a door on a piece of furniture provided with a front frame, comprising:

a base plate fixable to the front frame of the piece of furniture, said base plate extending according to a longitudinal plane;

an intermediate plate slidably connected to the base plate and movable, by an adjusting cam, along the longitudinal direction of the said longitudinal plane;

a hinge arm;

hinging means between said hinge arm and said intermediate plate according to an axis transversal to said longitudinal direction;

adjusting means for adjusting the angle between said hinge arm and said intermediate plate, comprising at least an adjusting screw; and a box fixable to a door of the piece of furniture, the box being swingably connected to a front end of said hinge arm by an articulation pin, characterized in that said hinging means are provided by a rear end of said hinge arm and by side wings of a rear end of said intermediate plate, and comprise holes and projections protruding according to said transversal axis for rotatably engaging in said holes.

Further characteristics of the present invention are further defined in the following claims.

According to the present invention, the side wings of the intermediate plate exhibit hinging projections fashioned in a single piece with the wings, which extend outwardly on opposite sides according to a transversal axis in order to engage rotatably in corresponding posterior side holes afforded on the flanks of the hinge arm, such as to avoid the need for a transversal pin for connecting and swinging the two parts with respect to one another.

In a preferred embodiment, the side holes on the flanks of the hinge arms are posteriorly open towards the outside such as to enable easy insertion of the hinge projections fashioned on the intermediate plate. It is however possible to arrange the posteriorly open holes on the intermediate plate and the projections faced towards the inside on the flanks of the hinge arm. This embodiment enables obtaining a swing axis which does not impede the inside of the hinge and which thus can be arranged at an appropriate distance from the side adjusting screw, at the adjusting cam between the intermediate plate and the base plate without interfering with it. In this way the hinge is functional and at the same time particularly compact.

Further, the base plate exhibits side retaining parts conformed such as to retain in a perpendicular direction the side edges of the intermediate plate, enabling at the same time a longitudinal displacement thereof and realising in this way a precise guide without play.

In a further embodiment the adjusting screw for the adjustment in a perpendicular direction to the longitudinal rest plane of the base plate is screwed into a threaded hole of the hinge arm and is rotatably retained therein with a lower shank thereof, but is not axially displaceable in a circular hole in the base plate, below which the shank of the screw is riveted. This solution guarantees a reliable and accurate adjustment of the hinge arm together with a high resistance of the coupling between the parts.

BRIEF DESCRIPTION OF THE DRAWINGS

The characteristics and advantages of the present invention will emerge more fully from the following description of a preferred but non-limiting embodiment of the hinge for pieces of furniture, with reference to the accompanying figures, in which.

DETAILED DESCRIPTION OF THE ILLUSTRATED EMBODIMENTS

Figure 1:
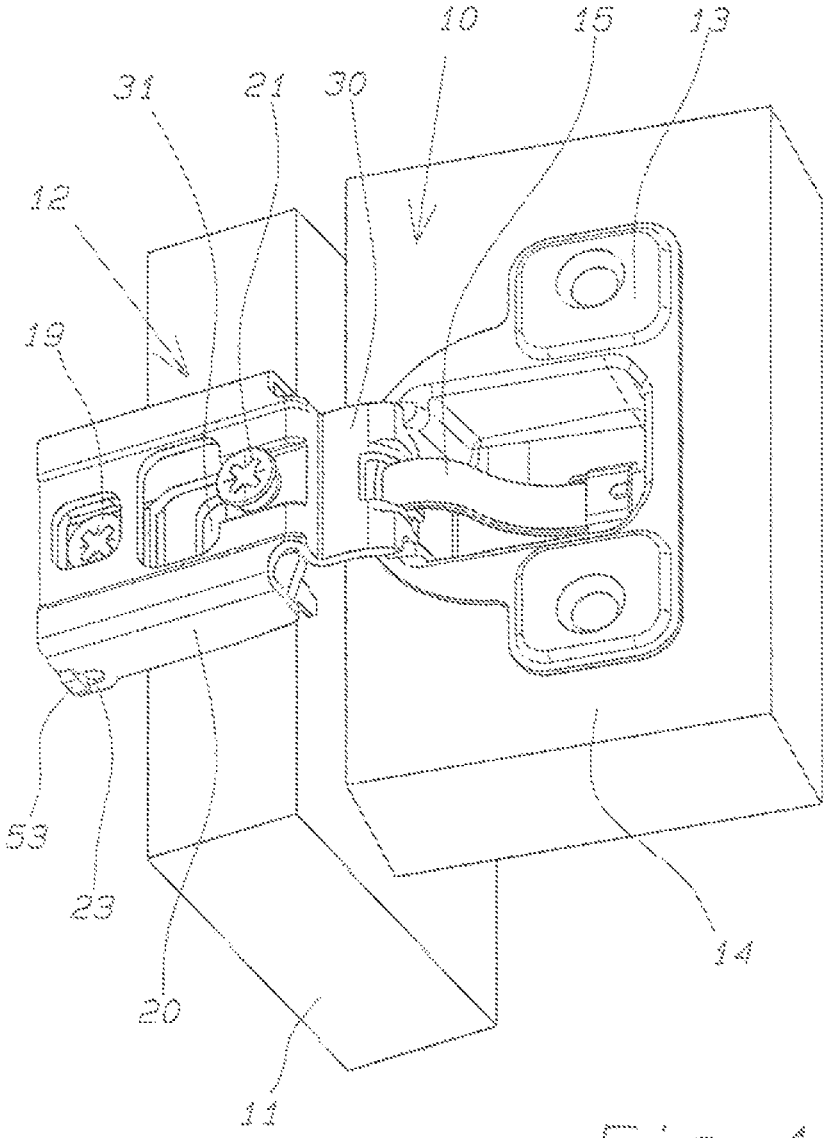
FIG. 1 is a perspective view of the hinge according to an embodiment of the invention.

The hinge of the present invention, denoted in its entirety in the accompanying figures by reference numeral 10, is applicable to pieces of furniture of the American type provided with a front frame 11 on which the hinges are fixed. This type of hinge 10 in general comprises a fixed part 12 for fixing the hinge itself to the front frame 11 of the piece of furniture and a box 13 for fixing to a door 14 of the piece of furniture.

Figure 2:
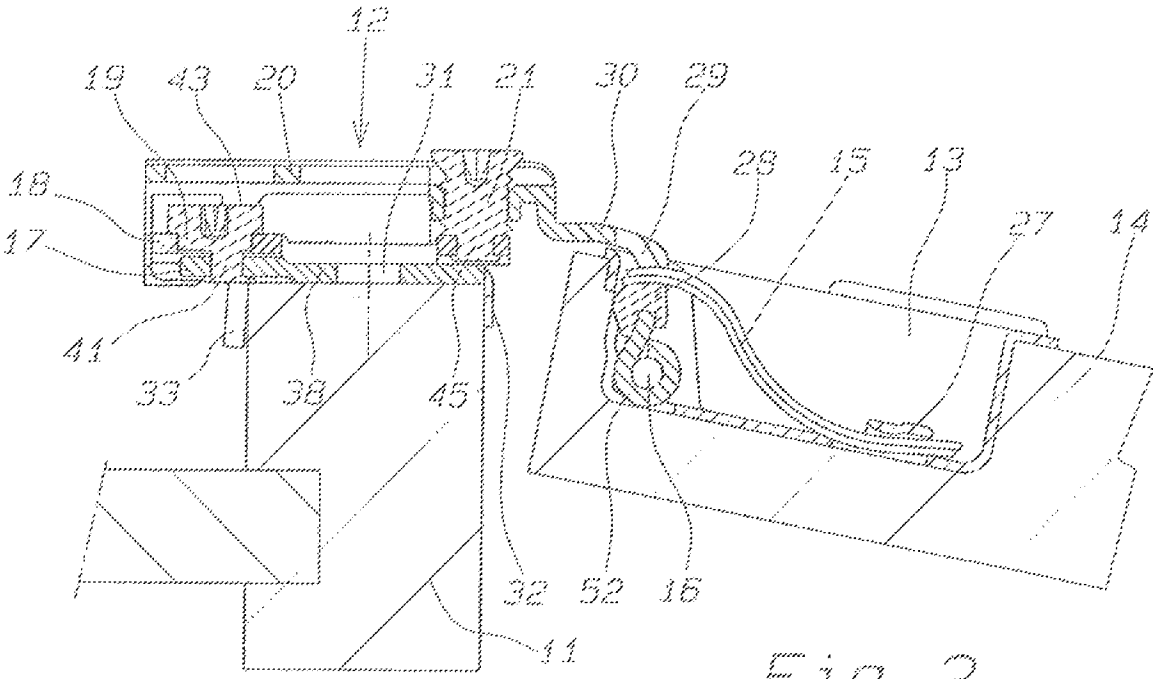
FIG. 2 is a view in median longitudinal section of the hinge of FIG. 1.

As more folly illustrated in FIG. 2, the box 13 is connected swingably to the fixed part 12 by an oscillation pin 16 which extends transversally, such that the box 13 can rotate between an open position of the door and a closed position of the door by action of a closing spring 15 of a leaf type housed in the box 13.

The closing spring 15 is preferable formed by two identical superposed leaves housed at an end thereof on the bottom of the box 13 for insertion under a bridge 27 formed by cutting of the bottom, as can more clearly be seen in FIG. 2. The other end of the spring 15 is curved towards the oscillation pin 16 and rests on a cam 28 inserted on the lower edge of an opening 29 afforded in the front part 30 of the hinge arm 20. The functioning of this type of closing spring is known and therefore not further described in detail.

The fixed part 12 of the hinge comprises a base plate 17 fixable to the front frame 11 of the piece of furniture by means of at least a screw (not illustrated) crossing at least an extended transversal cavity 31 arranged about in the central zone thereof. The base plate 17 extends essentially in a longitudinal rest plane and exhibits front and rear bent wings 32 and 33 which embrace the front frame of the piece of furniture. The base plate 17 exhibits side retaining parts formed such as to retain the side edges 34, 35 of an intermediate plate 18. The side retaining parts exhibit guide surfaces 36, 37 which extend substantially parallel to the longitudinal rest plane and are distanced from the bottom wall 38 of the base plate 17, defining in this way, on the two sides, respective housing seatings for the side edges 34, 35 of the intermediate plate 18.

In a preferred embodiment of the invention, the flanks of the base plate 17 exhibit front wings 25 bent inwardly and rear wings 26 which extend longitudinally in a posterior direction, defining, with the lower parts thereof the guide surfaces 36, 37 for the side edges 34,35 of the intermediate plate 18.

The side edges 35 of the intermediate plate 18 comprise, in a rear position, side prolongations 34 that are engageable with the rear wings 26 of the base plate 17. The base plate 17 further exhibits, in the rear zone thereof, side prolongations 39 which extend at a distance below the lower surfaces 37 of the rear wings 26, such as to close, in the assembled position, the side prolongations 34 of the intermediate plate 18.

For assembly, the intermediate plate 18 is housed internally of bent flanks of the base plate 17, causing it to slide from behind, such that the edges 35 thereof and the side prolongations 34 insert between the bottom wall 38 and the lower surfaces 36, 37 of the wings 25, 26 of the base plate 17. In the rear zone of the base plate 17 a hole 40 is provided for inserting the shank 41 of a earn 19, the end of which projecting below the hole 40 is riveted for fixing the cam to the base plate 17 rotatably, but not axially displaceably. The cam 19 crosses a transversal extended rear cavity 42 of the intermediate plate 18, above which it projects with a broadened head 43. In this way the intermediate plate 18 is retained inseparably on the base plate 17, but is displaceable along the longitudinal direction of the longitudinal plane of the base plate 17 by means of rotation of the cam 19.

The hinge comprises hinging means between the hinge arm 20 and the intermediate plate 18 along a transversal axis to the longitudinal direction of the longitudinal plane of the base plate 17. The hinging means in particular are provided by a rear end of the hinge arm 20 and by side wings 22 of a rear end of the intermediate plate 18, and comprise holes 24 and projections 23 which project along said transversal axis such as to engage rotatably in the holes 24.

Figure 3:
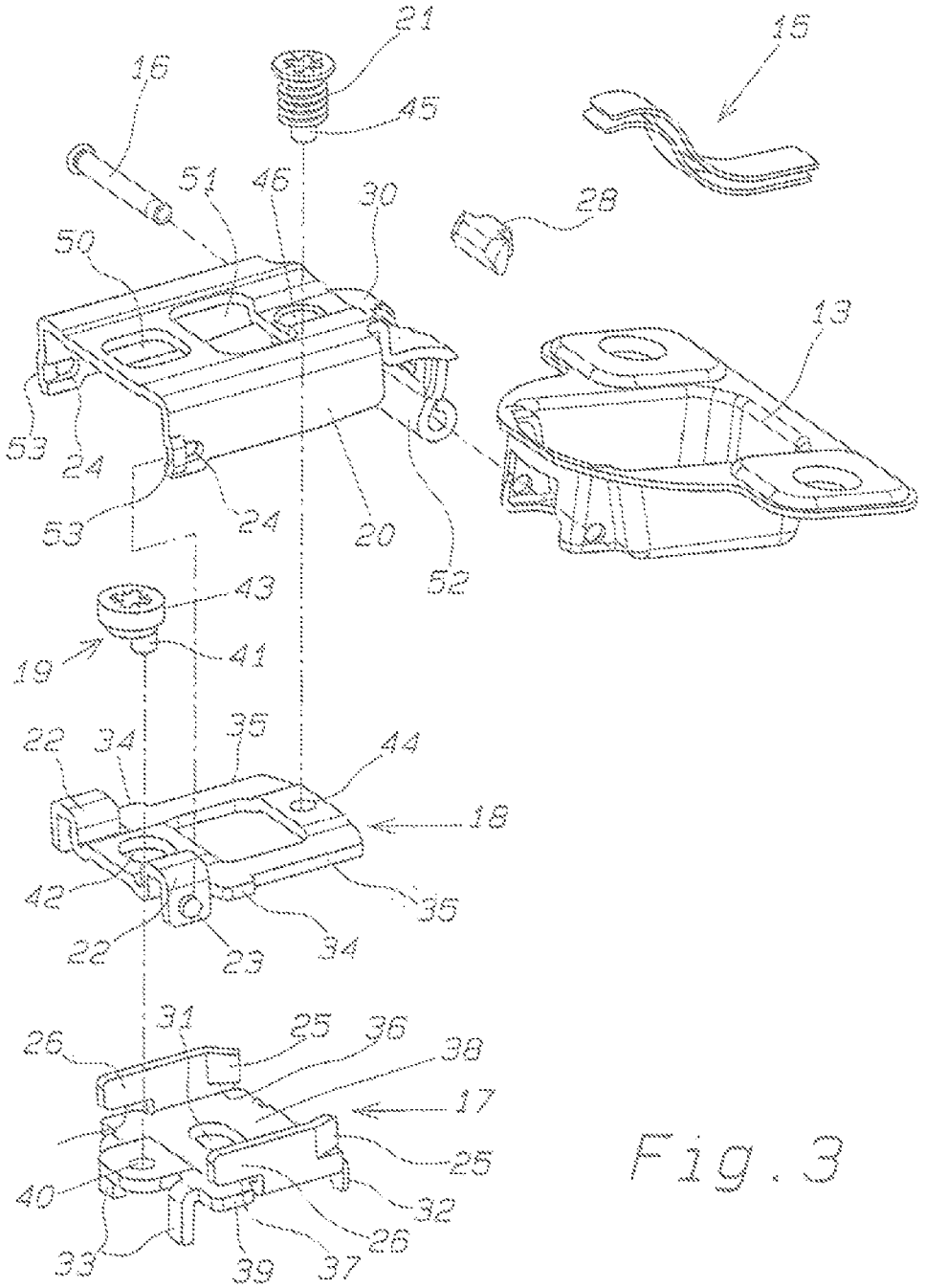
FIG. 3 is an exploded view of the hinge of FIG. 1.

In the illustrated embodiment the hinging projections 23 are provided on the wings 22 and are preferably made in a single piece with the side wings 22, which in the illustrated embodiment, as can be seen in FIG. 3, are constituted by parts of sheet metal projecting from the back of the intermediate plate and are bent in a U-shape in a downwards direction.

The hinge further comprises adjusting means of the angle between the hinge arm 20 and the intermediate plate 18, comprising at least an adjusting screw 21. In particular, a hole 44 is situated in the front part of the intermediate plate 18, into which hole 44 the shank 45 of an adjusting screw 21 is inserted, an end of which projecting below the hole 44 is riveted to fix the screw to the intermediate plate 18 rotatably but not axially displaceably. The threaded part below the head of the adjusting screw 21 engages in a threaded hole 46 present on the back of the hinge arm 20.

By rotating the adjusting screw 21, the hinge arm 20 can be distanced or neared swingingly with respect to the intermediate plate 18, securely and precisely. The hinging projections 23 extend about at the transversal cavity 42 of the intermediate plate 18, preferably posteriorly of the axis of the adjusting cam 19, such as to exhibit a suitable distance from the axis of the adjusting screw 21, such as to prevent excessive stresses and undesired deformations of the parts during the side adjusting deformations of the parts during the side adjustment of the hinge. The side wings 22 of the intermediate plate 18 advantageously exhibit external surfaces having a width equal to the width of the external surfaces of the flanks of the base plate 17.

The hinge arm 20 posteriorly exhibits a U-shaped transversal section, on the back of which are the threaded hole 46 and the apertures 50, 51 for access to the cam 19 and to the fixing screw of the base plate 17 to the front frame 11 of the piece of furniture. The front part 30 of the back of the hinge arm 20 is bent in a known way and exhibits the opening 29 for the cam 28 and the curl 52 for the housing of the articulation pin 16.

In the rear zone of the U-bent flanks, the hinge arm 20 exhibits side holes 24 open posteriorly towards the outside for the housing of the hinging projections 23 present on the opposite sides of the intermediate plate 18, forming the transversal axis about which the hinge arm 20 can be made to swing by means of the adjusting screw 21 for the side adjustment of the door 14.

The open posterior ends of the holes 24 are connected to one another, such as to strengthen them, by profiled bridges 53 projecting laterally on the flanks of the hinge arm 20, below which the hinging projections 23 can pass before the hinge arm 20 is fixed to the intermediate plate 18 by riveting the shank 45 of the adjusting screw 21.

The hinge of the invention is susceptible to modifications and variations falling within the scope of the inventive concept; further, the constructional details are replaceable by technically-equivalent elements.

The invention claimed is:

1. A hinge for mounting a door on a piece of furniture provided with a front frame, the hinge comprising:

a base plate fixable to the front frame of the piece of furniture, said base plate extending according to a longitudinal plane;

an intermediate plate slidably connected to the base plate and movable, by an adjusting cam, along a longitudinal direction of said longitudinal plane;

a hinge arm;

hinging means between said hinge arm and said intermediate plate according to an axis transverse to said longitudinal direction of said longitudinal plane;

adjusting means for adjusting an angle between said hinge arm and said intermediate plate, the adjusting means comprising at least an adjusting screw; and a box fixable to a door of the piece of furniture, the box being swingably connected to a front end of said hinge arm by an articulation pin;

wherein said hinging means are provided by a rear end of said hinge arm and by side wings of a rear end of said intermediate plate, wherein one of said rear end of said hinge arm and said side wings of said intermediate plate comprises holes, and the other of said rear end of said hinge arm and said side wings of said intermediate plate comprises projections protruding according to said transverse axis for rotatably engaging said holes.

2. The hinge according to claim 1, wherein said base plate has side retaining parts for said intermediate plate, said retaining parts being conformed and arranged for holding side edges of the intermediate plate in an orthogonal direction with respect to said longitudinal plane.

3. The hinge according to claim 2, wherein said side retaining parts have guide surfaces extending substantially parallel to said longitudinal plane and spaced apart from a bottom wall of the base plate, said guide surfaces and said bottom wall defining on the two sides respective receiving and sliding seats for said side edges of the intermediate plate.

4. The hinge according to claim 3, wherein said side retaining parts of the base plate comprise inwardly bent front wings and longitudinally extending rear wings, said front and rear wings defining said guide surfaces for the side edges of the intermediate plate.

5. The hinge according to claim 4, wherein said side edges of the intermediate plate comprise side rear prolongation engagable with the rear wings of said base plate.

6. The hinge according to claim 1, wherein said projections are provided on the side wings of said intermediate plate and protrude outwardly on opposite sides for rotatably engaging the holes provided on the hinge arm.

7. The hinge according to claim 1, wherein said projections are provided on the hinge arm and protrude inwardly on opposite sides for rotatably engaging the holes provided on the side wings of said intermediate plate.

8. The hinge according to claim 1, wherein said projections are integral with said hinge arm or with said side wings of said intermediate plate.

9. The hinge according to claim 1, wherein said intermediate plate is housed inside bent sides of the base plate, and wherein said side wings of the intermediate plate have outer surfaces having a width equal to that of the outer surfaces of the sides of the base plate.

10. The hinge according to claim 1, wherein the holes of the hinge arm are posteriorly open towards the outside, and wherein the rear open ends of the holes are connected with each other by laterally protruding bridges on the sides of the hinge arm.

11. The hinge according to claim 1, wherein said hinge arm has a threaded hole for engaging said adjusting screw, and wherein said intermediate plate has a hole for a retaining shank of the adjusting screw.

12. The hinge according to claim 1, wherein said intermediate plate has an extended rear cavity for engagement of said adjusting cam, and wherein said base plate has a circular hole for a shank of the adjusting cam.

13. The hinge according to claim 1, wherein the projections between said hinge arm and said intermediate plate extend rearwards with respect to the axis of the adjusting cam between said base plate and said intermediate plate.

14. The hinge according to claim 1, wherein said base plate has at least one extended cross hole for inserting a fixing screw for fixing the hinge to said front frame of the piece of furniture.

* * * * *